US009353942B2

(12) United States Patent
Stellema

(10) Patent No.: US 9,353,942 B2
(45) Date of Patent: May 31, 2016

(54) BURNER FOR HOUSEHOLD OR RECREATIONAL USE

(75) Inventor: Lammert Gosse Stellema, Heerenveen (NL)

(73) Assignee: CLEAN FIRE SYSTEM B.V., Broek Op Langendijk (NL)

( * ) Notice: Subject to any disclaimer, the term of this patent is extended or adjusted under 35 U.S.C. 154(b) by 842 days.

(21) Appl. No.: 12/066,800

(22) PCT Filed: Sep. 13, 2006

(86) PCT No.: PCT/NL2006/000454

§ 371 (c)(1),
(2), (4) Date: Jul. 23, 2008

(87) PCT Pub. No.: WO2007/032667

PCT Pub. Date: Mar. 22, 2007

(65) Prior Publication Data

US 2009/0214997 A1 Aug. 27, 2009

(30) Foreign Application Priority Data

Sep. 13, 2005 (NL) ..... 1029948

(51) Int. Cl.

| | |
|---|---|
| ***F23D 3/18*** | (2006.01) |
| ***F23D 3/24*** | (2006.01) |
| ***F23D 14/12*** | (2006.01) |

(Continued)

(52) U.S. Cl.

CPC .. *F23D 3/18* (2013.01); *F23D 3/02* (2013.01); *F23D 3/08* (2013.01); *F23D 3/40* (2013.01); *F23D 2900/05002* (2013.01)

(58) Field of Classification Search

CPC ..... F23D 3/02; F23D 3/08; F23D 3/18; F23D 3/40

USPC ..... 431/323, 328, 320, 125; 126/513, 92 R, 126/43, 45; 501/133

See application file for complete search history.

(56) References Cited

U.S. PATENT DOCUMENTS

| | | | | |
|---|---|---|---|---|
| 821,165 | A * | 5/1906 | Hollenbach | 431/328 |
| 1,345,419 | A | 7/1920 | Valentine | |

(Continued)

FOREIGN PATENT DOCUMENTS

| | | | |
|---|---|---|---|
| DE | 678 253 | A | 7/1939 |
| DE | 295 12 434 | U1 | 10/1995 |

(Continued)

OTHER PUBLICATIONS

BNZ S.A., "BNZ s.a. Insulating Fire Brick", Jun. 2004, pp. 1-2.

*Primary Examiner* — William G Corboy
(74) *Attorney, Agent, or Firm* — Pearne & Gordon LLP

(57) ABSTRACT

A burner for household or recreational use, such as for generating a decorative play of flames, emission of heat or use in, for instance, a hot plate or fireplace, in a generally safe, clean and efficient manner. The burner is equipped with a fuel stock holder (2, 22) provided with a fuel receiving body (5, 25, 45) from a form-retaining, isotropic, heat-resistant and porous material for retaining liquid fuel by means of absorption. The fuel receiving body (5, 25, 45) is located in a casing (9, 29, 49) with at least one flame opening (10, 30, 50) for combusting fuel at the surface of the fuel receiving body and which is connected to the fuel receiving body (5, 25, 45) without substantial residual spaces remaining between the casing (9, 29, 49) and the fuel receiving body (5, 24, 45), or the fuel receiving body is arranged freely without casing.

27 Claims, 4 Drawing Sheets

(51) Int. Cl.

| | |
|---|---|
| ***F24C 5/00*** | (2006.01) |
| ***F24C 5/04*** | (2006.01) |
| ***C04B 33/04*** | (2006.01) |
| ***F23D 3/02*** | (2006.01) |
| ***F23D 3/08*** | (2006.01) |
| ***F23D 3/40*** | (2006.01) |

(56) References Cited

U.S. PATENT DOCUMENTS

| | | | | | |
|---|---|---|---|---|---|
| 3,031,340 | A | * | 4/1962 | Girardot | 428/420 |
| 3,290,907 | A | | 12/1966 | Boij et al. | |
| 3,650,661 | A | * | 3/1972 | Laguinia | 431/328 |
| 3,810,732 | A | * | 5/1974 | Koch | 431/7 |
| 4,043,765 | A | | 8/1977 | Tanner | |
| 4,229,159 | A | * | 10/1980 | Ohmukai et al. | 431/328 |
| 4,416,617 | A | * | 11/1983 | Ebbeson | 431/326 |
| 4,455,927 | A | * | 6/1984 | Schweizer | 99/425 |
| 4,557,687 | A | | 12/1985 | Schirneker | |
| 4,597,734 | A | | 7/1986 | McCausland et al. | |
| 4,889,481 | A | * | 12/1989 | Morris et al. | 431/328 |
| 5,006,498 | A | * | 4/1991 | Kim | 502/68 |
| 5,017,312 | A | * | 5/1991 | Peters et al. | 264/438 |
| 5,281,130 | A | * | 1/1994 | LeBaigue | 431/125 |
| 5,532,461 | A | * | 7/1996 | Crummenauer et al. | 219/621 |
| 6,035,847 | A | | 3/2000 | Paul | |
| 6,293,274 | B1 | | 9/2001 | Anderson et al. | |
| 6,347,936 | B1 | | 2/2002 | Young et al. | |
| 7,458,808 | B2 | * | 12/2008 | McCarren | 431/125 |
| 2001/0035463 | A1 | | 11/2001 | Takagi et al. | |
| 2002/0086253 | A1 | | 7/2002 | Young et al. | |
| 2005/0227194 | A1 | * | 10/2005 | Weinberger | 431/331 |

FOREIGN PATENT DOCUMENTS

| | | | | | |
|---|---|---|---|---|---|
| EP | 0 978 686 | B1 | | 2/2000 | |
| FR | 2 432 680 | A1 | | 2/1980 | |
| FR | 2432680 | | * | 2/1980 | F21S 13/00 |
| FR | 2432680 | A | * | 4/1980 | |
| GB | 2 243 904 | A | | 11/1991 | |
| NL | 1 020 999 | C2 | | 1/2004 | |
| SE | 9000494 | A | | 7/1990 | |

* cited by examiner

BURNER FOR HOUSEHOLD OR RECREATIONAL USE

The invention relates to a burner for household or recreational use, such as for generating a decorative play of flames, emission of heat or use in, for instance, a fireplace or hot plate, comprising a fuel stock holder with a fuel receiving body from heat-resistant material for receiving liquid fuel by absorption.

Such a burner is known from applicant's Dutch patent specification 1 020 999.

The use of fire to enhance the atmosphere has been applied since time immemorial. Here, use is made of, for instance, candles, oil lamps, tea-warmers, braziers, torches, fireplace, etc.

In practice, there are some drawbacks to the use of fire. Firstly, there is a safety risk. For instance, a fire can start by fire spreading to combustible materials in the surroundings, such as clothes, tablecloth or canvas. This may, for instance, be caused by fire spreading rapidly after knocking over a reservoir of (liquid) fuel, or by sparks of burning material, which are taken along by combustion gases.

Also, a traditional fire generally causes combustion residues, such as smoke and soot, which form a load for the environment and public health. This is particularly a problem with indoor use of fire. A fire in, for instance, a fireplace therefore requires an expensive flue discharge channel.

With the burner according to the above-mentioned Dutch patent specification 1 020 999, these drawbacks are obviated in that a fuel which is combustible without any appreciable soot formation is received in a body from fiber material and is gradually released therefrom during burning. These fibers have a textile character and retain the liquid fuel by means of capillary action. In case of a leak or knocking over the burner, this prevents the liquid fuel from spreading and a large amount of fuel from becoming available for combustion.

Due to the use of a suitable liquid fuel and the absence of a fuse, there is virtually no soot and smoke formation. This makes this type of burner excellently suitable for indoor use, for instance in a so-called atmospheric fireplace, without a flue or other discharge being needed.

A drawback of this solution is that, in use, the burner stops burning due to lack of fuel while a considerable part of the fuel received by the fibers is still present in the reservoir. This reduces the capacity of the burner and consequently the maximum burning time without refilling. A further drawback is that, when the body from fiber material is carelessly placed in the casing of the storage reservoir, cavities can remain between the body from fiber material and the casing, in which fuel is not bound against running off and/or in which fuel vapor can form which can make the burner explode.

The object of the invention is to provide a burner with which, while maintaining above-mentioned advantages, above-mentioned drawbacks occur at least to a materially lesser extent.

This object is achieved with the disclosed invention by providing a burner according to claim 1. In addition, the invention provides the use of such a burner according to claim 22.

Due to the fact that the fuel receiving body is formed by an isotropic material, a better and more uniform conduction of heat and fuel by the fuel receiving body is obtained during burning. Due to the fact that, here, the fuel receiving body is formed from a form-retaining material, a casing can be omitted or it is guaranteed that, upon placement of the fuel receiving body in a matching casing, no substantial residual spaces remain between the casing and the fuel receiving body, so that a possible cause of exploding of the burner is removed. The favorable conducting properties of the material also provide more freedom in determining the shape of the fuel receiving body and the place of a flame area. The flame area is that part of the fuel receiving body where the fuel is released in volatile form and combusts. With a small flame area, little fuel escapes, so that the fuel consumption is low and the flame is small. A larger flame area gives larger flames, a larger heat emission and a high fuel consumption per unit of time. Also, the form-retaining material of the fuel receiving body retains the fuel if a considerable pressure is exerted thereon. As a result the risk of uncontrolled spreading of the, burning, fuel is minimal.

Due to the fact that the material of the fuel receiving body is heat-resistant, it does not release any harmful, irritating or otherwise undesirable substances upon combustion of the absorbed fuel. This makes a burner according to the invention excellently suitable for indoor use and in situations where people are in the immediate surroundings of the fire source, like on a terrace.

The invention further provides a kit comprising a burner and fuel as well as an atmospheric fireplace with such a burner.

Special embodiments of the invention are set forth in the dependent claims.

These and other aspects as well as effects and detail related to the invention are described in the following, inter alia with reference to the exemplary embodiments shown in the drawing, in which.

Figure 1:
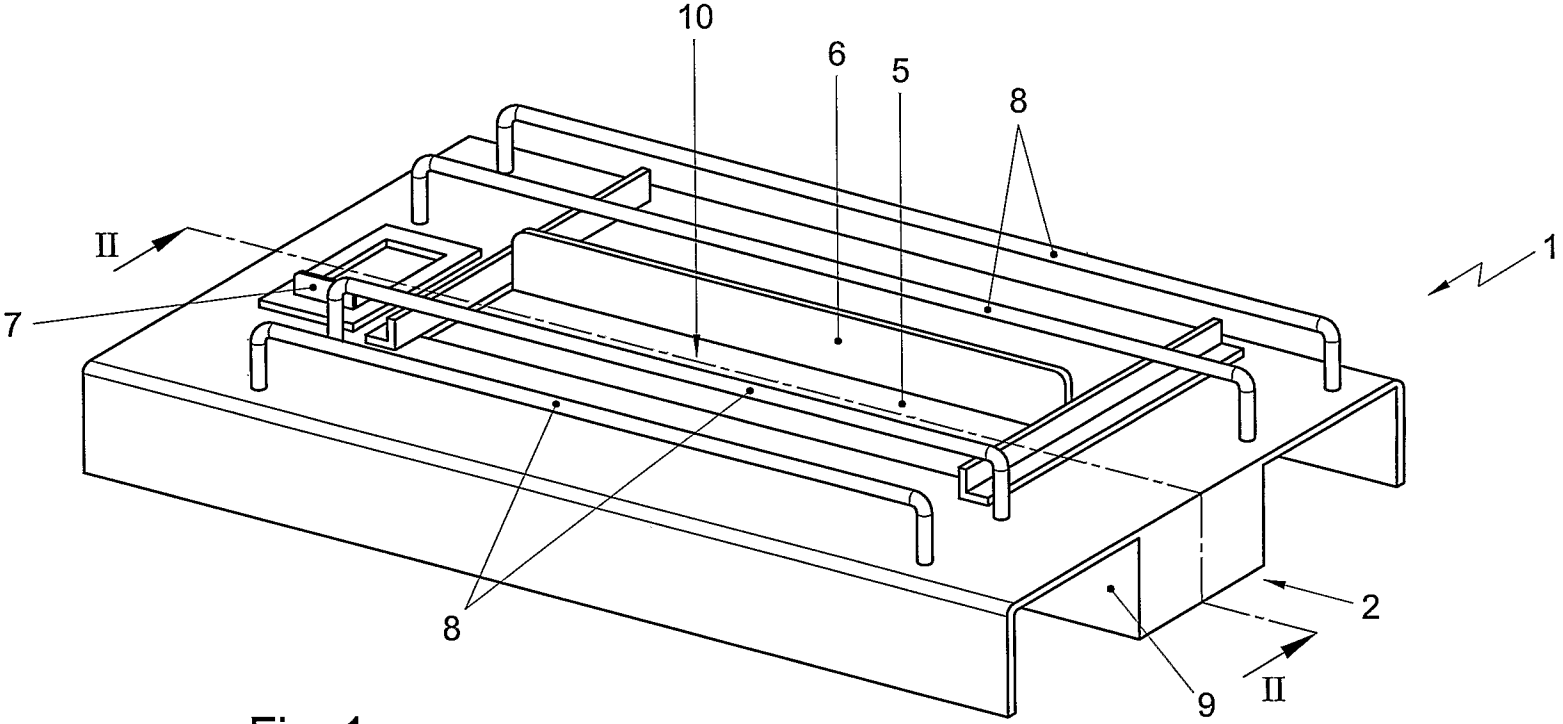
FIG. 1 shows a schematic perspective representation of a burner according to the invention.
Figure 2:
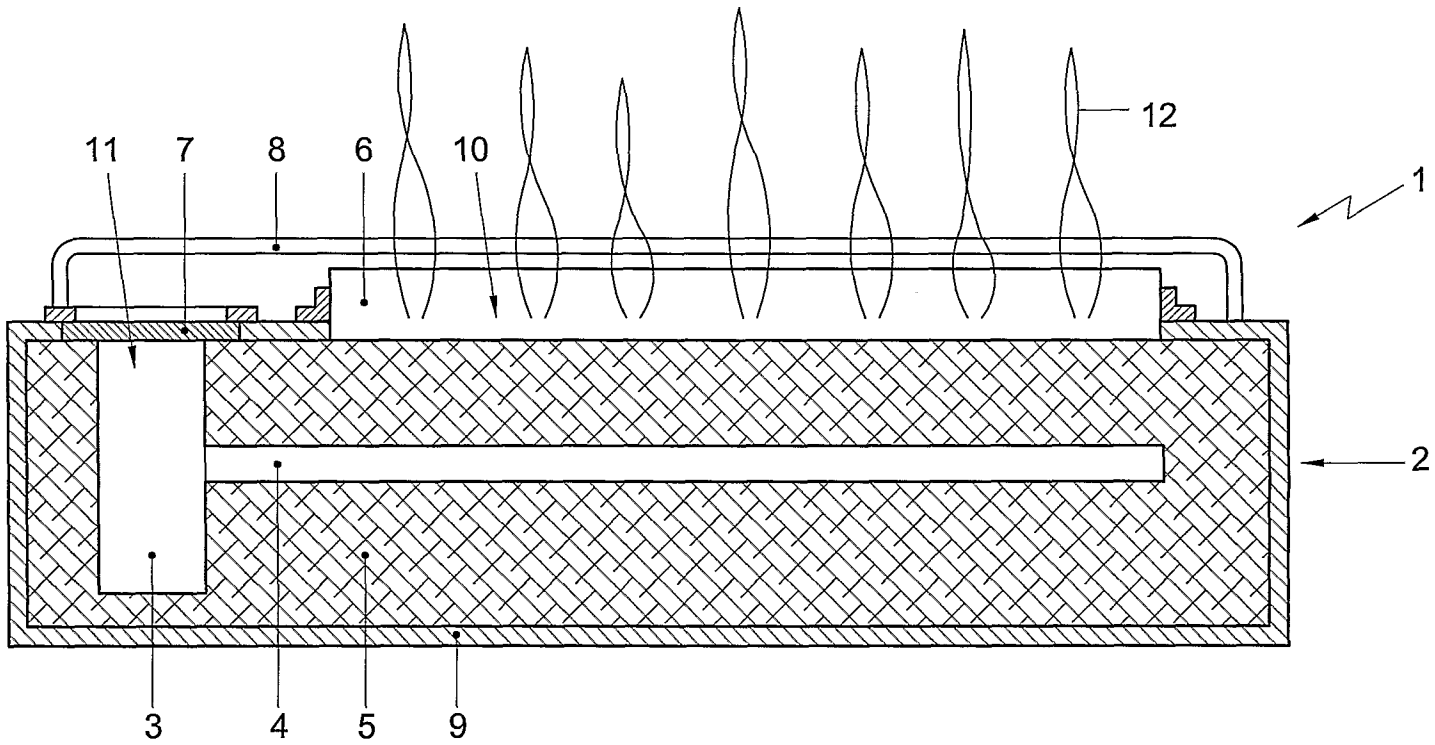
FIG. 2 shows a schematic cross section of the burner of FIG. 1.

The burner 1 according to the example shown in FIGS. 1 and 2 is equipped with a fuel holder 2 for receiving a fuel stock. The fuel holder 2 is provided with a fuel receiving body 5 from a form-retaining, isotropic, heat-resistant and porous material for retaining liquid fuel by means of absorption. Due to the fact that the material has an isotropic structure, the heat coming from the flame 12 can spread uniformly over the body 5. As a result, the body and the fuel therein are uniformly heated, which is favorable to the release of fuel from the fuel receiving body 5. In particular, it is advantageous that the fuel receiving body 5 becomes warmer as the flame burns longer and the fuel receiving body 5 gets empty. The release of fuel is thus stimulated more strongly as this is more important due to the fuel running out. Thus, the amount of fuel which remains in the open cell structure of the fuel receiving body 5 when the flame goes out due to lack of fuel is strongly reduced. A further advantage of the isotropic structure is that the fuel can flow to a flame area 10 irrespective of the direction of movement needed for this. In the example shown, combustion of the fuel takes place in the flame area 10, defined by the opening in the casing 9, on or near a surface of the fuel receiving body 5, as shown with the flames 12 in FIG. 2.

The material of the fuel receiving body 5 is heat-resistant, which means that, at temperatures as they occur with normal use of the burner 1, the material does not burn and the structure of the material remains preserved. As a result, the fuel holder 2 can be used repeatedly. This temperature resistance preferably remains present to at least 1000 degrees Celsius. Due to the fact that the material is not lost during the combustion of the fuel, no harmful by-products such as smoke or soot are created. The makes the burner 1 according to the invention excellently suitable for indoor use.

In the exemplary embodiment shown in FIG. 1, the material of the fuel receiving body 5 is a ceramic material. Preferably, the material of the fuel receiving body comprises at least $Al_2O_3$ or $SiO_2$, preferably in volume percentages of at least 10% $Al_2O_3$ and/or at least 10% $SiO_2$, preferably in volume percentages of 30-50% $Al_2O_3$ and 40-65% $SiO_2$. Such material has a high thermal stability and, for instance, expands only 0.5% with heating to 1000 degrees Celsius. Further, it is advantageous if the material contains a small percentage (for instance in volume percentage 0.5-3%) of $Fe_2O_3$.

However, the material of the fuel receiving body 5 may be of any suitable type. For instance, an insulating fireproof brick may also be used as a fuel receiving body 5 in a burner 1 according to the invention, such as for instance the type of brick which is commercially available under the name of Calor RI 23 with 34% $Al_2O_3$, 57% $SiO_2$ and 1.2% $Fe_2O_3$.

The fuel receiving body 5 preferably has a density smaller than or equal to 775 kg/m$^3$, preferably smaller than or equal to 725 kg/m$^3$, preferably between 625 and 675 kg/m$^3$. In addition, the body 5 preferably has a porosity of at least 50-60% of its own body volume. If the fuel receiving body 5 has, for instance, dimensions of 23×11×6.5 centimeters, it has a total volume of 1.6 dm$^3$ and can receive approx. one liter of fuel. This is advantageous because a manageable volume is coupled to a burning time of well over three hours, depending on the size of the flame area. Also, larger volumes can be used for, for instance, a larger flame area or extra burning time, or multiple bodies can be placed in a burner, each, for instance, having its own flame area.

Due to the fact that the fuel receiving body 5 is form-retaining, after placement in a matching casing 9, there are no residual spaces for substantial accumulation of fuel vapor between the body 5 and the casing 9, without the placement requiring special care. Because the fuel receiving body 5 is, in addition, heat-resistant, such spaces can neither be created during use.

The fuel vapor-tight casing 9 connected to the walls of the fuel receiving body 5 is provided with a closable flame opening 10, via which fuel vapor can exit and can combust during the burning. It is also possible to provide multiple, optionally smaller such flame openings.

The casing 9 according the exemplary embodiment shown in FIG. 1 is folded from plate material and is, in addition, provided with a closable filling opening 11 for filling the fuel receiving body 5 with fuel.

The closable flame opening 10 defines the flame area, and can be closed with a first slide 6 when the burner 1 is not in use. By vapor-tight closing of the opening with, for instance, a valve, any residue of fuel present in the fuel receiving body 5 is preserved and can be combusted at a later occasion. The slide 6 for closing the flame area 10 can also be used for dimming or extinguishing the flame during use by closing the slide 6 to a greater or lesser extent.

By using, for the vapor-tight casing 9, a material with a good heat conduction, for instance 35 W/mK or more, the casing can contribute to a uniform heating of the fuel receiving body 5. For this, the vapor-tight casing 9 may, for instance, be formed from a metal with a wall thickness of preferably 1 to 2 millimeters, and at most 3 millimeters in order to suitably dose the heat conduction via the housing. Also, an insulating holder may be provided for safely placing the burner on a heat-sensitive base, such as for instance varnished wood. In order to facilitate the filling of the burner 1, a filling shaft 3 is left open in the fuel receiving body 5. The purpose of this shaft 3 is, firstly, to provide a space into which the fuel can be poured and, secondly, to increase the absorbing surface of the fuel receiving body 5, to thus accelerate the receipt of the fuel by the body 5 and to make smooth pouring of the fuel possible.

The fuel holder 2 is further provided with a fuel distribution channel 4 at least partly enclosed by the fuel receiving body 5, which is connected with the filling shaft 3. Due to the use of distribution channels in the fuel receiving body 5, the fuel quickly spreads over the fuel receiving body 5 during filling, also when the filling shaft 3 is not placed centrally. The filling shaft 3 is preferably closed with a separate valve or second slide 7, so that it will not act as a flame opening during burning. In the exemplary embodiment shown in FIGS. 1 and 2, the openings are closed with a slide, but alternatively this may also be done with, for instance, a hinged valve, lid, etc.

Alternatively or additionally, it is also possible to connect a fuel supply line which communicates with a fuel reservoir at a distance from the burner to the filling opening or another opening in the casing provided to this end. Preferably, such a fuel supply line communicates with the fuel distribution channel left open in the fuel receiving body. In the fuel supply line, a dosing device such as a float-controlled valve may be included for dosing the supply of fuel to the fuel receiving body.

Figure 3:
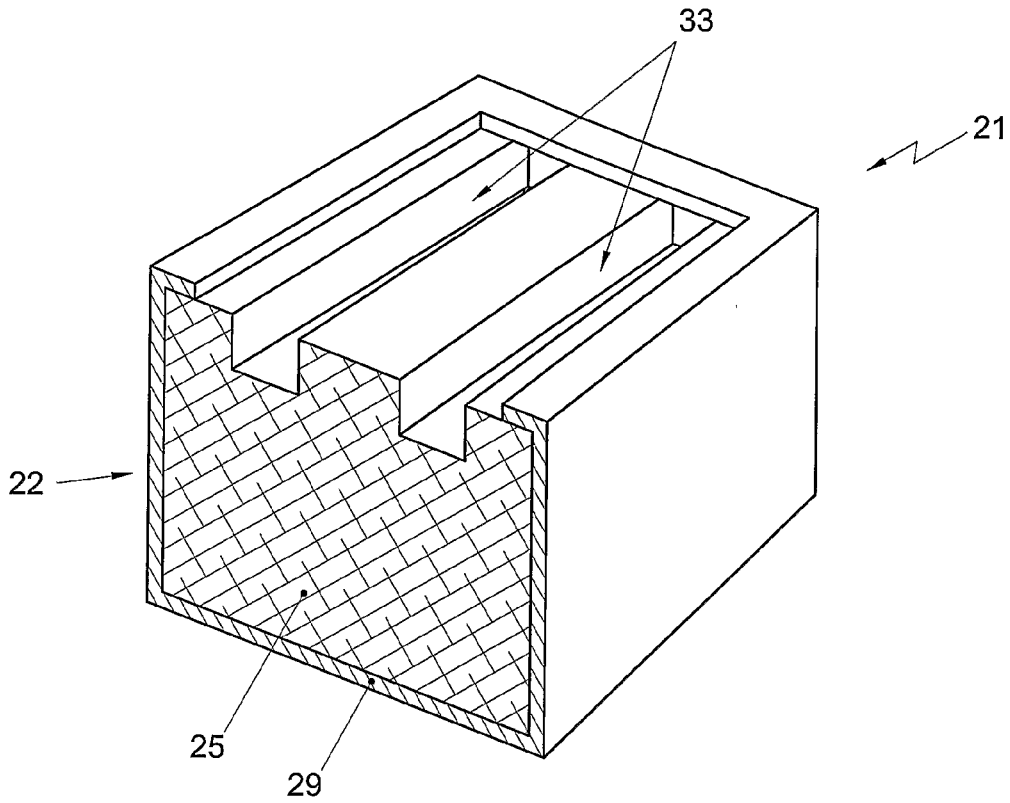
FIG. 3 shows a schematic perspective representation of a cross section of a second burner according to the invention.
Figure 4:
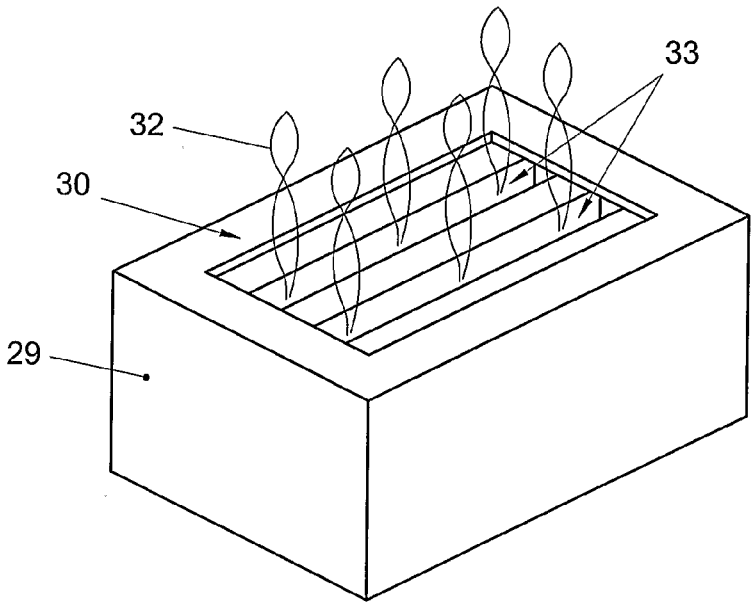
FIG. 4 shows a schematic perspective representation of the burner according to FIG. 3.

A second exemplary embodiment of a burner 21 according to the invention is shown in FIGS. 3 and 4. The fuel receiving body 25 is set in a casing 29 which leaves the top side of the body almost completely free as flame area 30. The body 25 is provided with grooves 33 in the surface in order to facilitate the filling and to limit the risk of overflowing. As a result, the receiving surface is increased and a temporary excess of fuel is retained so that it does not directly run off the fuel receiving body. The burner according to this exemplary embodiment may, for instance, be used as a brazier in the garden or on the campsite. The flame opening of this fuel holder 22 may optionally be closed with a lid (not shown) to extinguish the flames 32.

The liquid fuel may, for instance, be a fuel with isopropyl alcohol and ethyl alcohol. The volume ratio of isopropyl alcohol to ethyl alcohol may, for instance, be 1:1. The volume percentage of water may be between 0 and 15, but may also be lower, such as between 0 and 10%, or between 0 and 5%. A liquid fuel with a low percentage of water has the advantage that, during combustion of the fuel, little water is introduced into the atmosphere, little water remains in the fuel receiving body and the fuel receiving body is heated well, which is favorable to the evacuation of fuel.

For use of the burner in certain applications, a choice may also be made for a non-vapor-tight casing, for instance with use of the burner in braziers on a terrace or balcony, or for completely omitting a casing, for instance with use in a fire basket. Here, use can be made of fuel receiving bodies with a limited size, for instance in the shape of a flat disc with a diameter of 10 centimeters and a thickness of 2.5 centimeters. Depending on the desired size of the campfire or the volume of the fire basket, then more or fewer fuel receiving bodies can be used. In this manner, for instance, a campfire on a campsite can be enjoyed without neighbors being bothered by the smoke, or fire hazard due to stray sparks of burning material.

Another possibility is the use of the burner 1 in a decorative fireplace. This type of fireplaces looks like a classic fireplace, but is not provided with a discharge channel. For this purpose, the burner 1 may, for instance, be provided with brackets 8 on which blocks of artificial wood can be placed. In addition, a holder may also be used as a heat source in a traditional fireplace, with the great advantage that no wood blocks need to be stored next to the fireplace, and no ash needs to be cleaned up afterwards.

Figure 5:
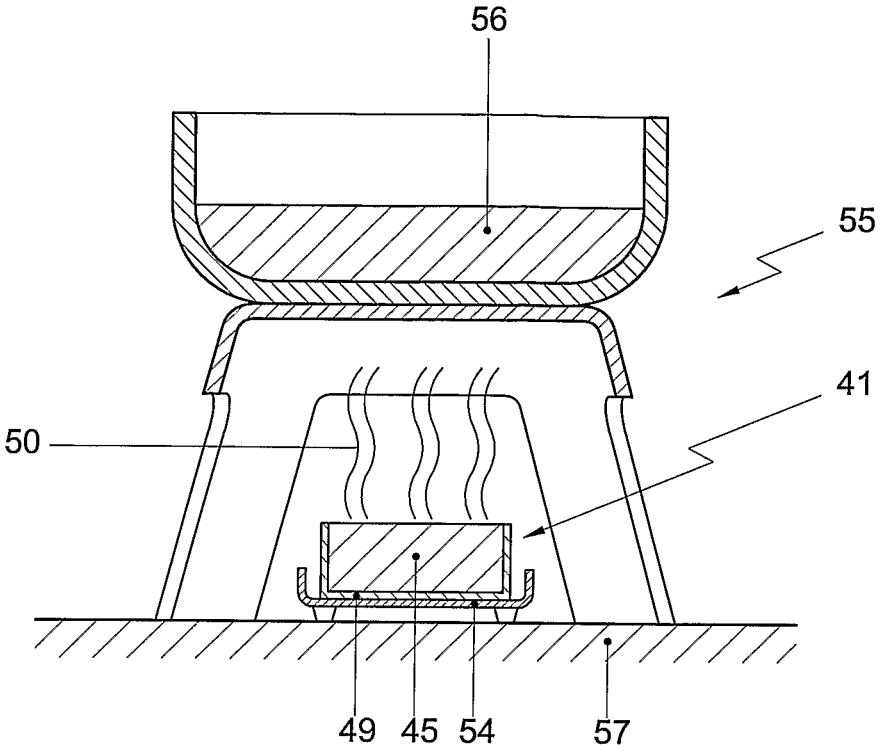
FIG. 5 shows a schematic cross section of a third burner according to the invention.

Further, the burner can be used as a heat source in the hotel and catering industry. For instance in a hot plate or under a fondue set, or for preparing food in the restaurant at the guest's table. The ventilation in, for instance, restaurants is, in contrast to in the kitchen, often not optimal for using open fire. However, because of the atmosphere-enhancing effect, the use of fire is preferred to, for instance, electric heating elements for, for instance, keeping dishes hot and preparing dishes at tables. For keeping a dish hot, for instance, use can be made of an exemplary embodiment as shown in FIGS. 1 and 2. On the brackets 8, then plates or pans can be placed. Optionally, it can be decided to design the surface or the shape of the flame area differently for this purpose, or, for instance, to have a configuration with multiple small flame areas. For heating, for instance, a fondue set, use may also be made of a cylindrical fuel receiving body, optionally placed in a holder which is also used for use with liquid fuel, or as shown in FIG. 5. In this exemplary embodiment, a burner 41 with fuel receiving body 45 is placed on a holder 54 under a fondue set 55 with melted cheese 56. The casing 49 of body 45 leaves the complete top side of the body 45 free as flame area 50. The holder 54 prevents the base, in this case a tabletop 57, from being damaged by the heat of the burner 41. The burner 41 can be extinguished by placing a lid (not shown) over the fuel receiving body 45.

Due to the fact that no fuse needs to be used, a burner according to the invention has a more lively play of flames than, for instance, a candle or an oil lamp. This makes the burner excellently suitable for atmospheric lighting on, for instance, tables in restaurants.

Further, the burner may be sold as part of a kit of which a burner and a liquid fuel suitable for use therein are part. The advantage is that the fuel is transported safely and that the consumer can use the burner directly after buying it without fuel needing to be bought.

The invention claimed is:

1. A burner for household or recreational use, for generating a decorative play of flames, emission of heat or use in a fireplace or hot plate, comprising a fuel stock holder with a fuel receiving body from heat-resistant material for receiving liquid fuel by absorption, wherein the fuel receiving body is located in a casing with at least one flame opening for combusting fuel at a combustion surface of the fuel receiving body, the casing having a bottom and the casing fitting to the fuel receiving body, the casing providing a perimeter wall surrounding the fuel receiving body, an entirety of the perimeter wall extending as high or higher than an entirety of said combustion surface, the material of the fuel receiving body is a porous, isotropic ceramic brick material for receiving the liquid fuel by means of the absorption, the ceramic material of the fuel receiving body extends upwardly from adjacent the bottom of the casing, the burner is free of any fuel supply line for supplying fuel to the fuel receiving body, a fuel distribution channel extends horizontally through the fuel receiving body, a filling shaft extends downwardly from a top of the fuel receiving body, and the fuel distribution channel is in fluid communication with the filling shaft, and the filling shaft is provided with a closure so that the filling shaft will not act as a flame opening during burning.

2. A burner according to claim 1, wherein the fuel stock holder is provided with the fuel distribution channel at least partly enclosed by the fuel receiving body.

3. A burner according to claim 1, wherein the material of the fuel receiving body contains $Al_2O_3$.

4. A burner according to claim 1, wherein the material of the fuel receiving body contains $SiO_2$.

5. A burner according to claim 1, wherein the material of the fuel receiving body contains at least 10% $Al_2O_3$.

6. A burner according to claim 1, wherein the material of the fuel receiving body contains at least 10% $SiO_2$.

7. A burner according to claim 1, wherein the material of the fuel receiving body contains 30-50% $Al_2O_3$ and 40-65% $SiO_2$.

8. A burner according to claim 1, wherein the material of the fuel receiving body contains 0.5-3% $Fe_2O_3$.

9. A burner according to claim 1, wherein the material of the fuel receiving body has a density lower than or equal to 775 $kg/m^3$.

10. A burner according to claim 1, wherein the material of the fuel receiving body has a density lower than or equal to 725 $kg/m^3$.

11. A burner according to claim 1, wherein the material of the fuel receiving body has a density between 625 $kg/m^3$ and 675 $kg/m^3$.

12. A burner according to claim 1, wherein the material of the fuel receiving body has a porosity of at least 50%.

13. A burner according to claim 1, wherein, in the fuel receiving body, a filling shaft is left open.

14. A burner according to claim 1, wherein the casing is fuel vapor-tight and is, in at least one place, provided with a closable opening.

15. A burner according to claim 14, wherein the fuel vapor-tight casing is formed from a material with a heat conduction of at least 35 W/mK.

16. A burner according to claim 15, wherein the fuel vapor-tight casing is formed from a metal.

17. A burner according to claim 16, wherein the casing has a wall thickness of minimally 1-3 mm.

18. A burner according to claim 1, wherein the fuel receiving body is heat-resistant to a temperature of at least 1000 degrees Celsius.

19. A kit comprising a burner according to any one of the preceding claims and a liquid fuel with isopropyl alcohol and ethyl alcohol.

20. An atmospheric fireplace comprising a decorative surround and a burner according to claim 1 placed therein.

21. Use of an apparatus according to claim 1, wherein fuel from the fuel receiving body is combusted at the surface of the fuel receiving body.

22. A burner according to claim 1, wherein the fuel receiving body is located in the casing for combusting fuel on a top side of the fuel receiving body below the flame opening and facing upwardly through the opening.

23. A burner according to claim 22, wherein the casing partially covers a top surface of the fuel receiving body.

24. A burner according to claim 1, wherein the fuel receiving body has an open cell structure.

25. A burner according to claim 1, wherein the filling shaft extends downwardly from a top of the fuel receiving body and wherein the closure is a slide cover.

26. A burner according to claim 1, wherein the flame opening is provided with a flame opening closure so that the flame opening can be closed.

27. A burner according to claim 1, wherein the flame opening is closable via a slide.

* * * * *